United States Patent [19]

Arnold

[11] 4,127,203

[45] Nov. 28, 1978

[54] TOOL CONNECTING SYSTEM

[75] Inventor: Carroll H. Arnold, Westminster, Mass.

[73] Assignee: Wain-Roy, Inc., Hubbardston, Mass.

[21] Appl. No.: 820,170

[22] Filed: Jul. 29, 1978

[51] Int. Cl.[2] ..... E02F 3/81

[52] U.S. Cl. ..... 214/145 A; 172/272

[58] Field of Search ..... 214/145 R, 145 A; 37/117.5, 118 R, 118 A; 172/272, 273

[56] References Cited

U.S. PATENT DOCUMENTS

| | | | |
|---|---|---|---|
| 3,341,040 | 9/1967 | Blair | 214/145 R X |
| 3,398,472 | 8/1968 | Leijon | 37/118 R |
| 3,556,323 | 1/1971 | Heimmermann | 214/145 A |
| 3,767,075 | 10/1973 | Leverenz | 214/145 R X |
| 3,853,232 | 12/1974 | Oke et al. | 214/145 R |

*Primary Examiner*—L. J. Paperner

[57] ABSTRACT

A system for connecting a boom to a tool of the type in which brackets secured to the tool define a pair of coaxial, axially-spaced bores, and the boom defines a pair of cylindrical coaxial bosses. In such a system, the invention features a stop associated with each of the bores and providing an alignment surface, typically defined by a cylinder coaxially with the bore and of radius not less than that of a boss. The stop surfaces face generally towards the center of gravity of the tool, each stop surface subtends an arc in the range of 120° to 180°, and each stop is open on the side of the associated bore opposite the stop surface thereof.

16 Claims, 4 Drawing Figures

GROUND LEVEL
CG
L
L'

TOOL CONNECTING SYSTEM

BACKGROUND OF THE INVENTION

This invention relates to materials handling and, more particularly, to mounting materials handling tools (e.g., buckets, blades, rippers, augers and the like) on, for example, dippersticks of backhoes.

The changing of materials handling tools mounted on a backhoe dipperstick traditionally has been a laborious and timeconsuming job. Some have suggested simplifying this task by connecting different tools to, rather than replacing, the bucket; or by providing connecting mechanisms on the tool and dipperstick which reduce the time and effort required for tool change-over. Such schemes have suffered from various drawbacks, principally the need for precise vertical alignment of the tool and dipperstick, the inability of the backhoe operator to change tools himself, the danger presented by improperly or incompletely connected tools, and the requirement that a different set of tools be provided for each size or type of backhoe. The system shown in my prior U.S. Pat. No. 3,934,738, issued Jan. 27, 1976, permits any of a wide range of materials handling tools to be connected to any type of backhoe, permits a single operator to change tools, often without leaving his seat; eliminates the danger of falling tools, and permits the same tools to be used with either a fixed or a swinging connector.

SUMMARY OF THE INVENTION

It is a principal object of the present invention to provide a system for releasably engaging any of a wide range of materials handling tools which has most of the advantages of the system disclosed in my prior patent, overcomes the drawbacks inherent in other schemes, and requires no change to conventional dippersticks and bucket linkages and only slight modification to the existing tools to be attached thereto.

The invention is included in a system for connecting a boom to a tool of the type in which brackets secured to the tool define a pair of coaxial, axially-spaced bores, and the boom defines a pair of cylindrical coaxial bosses. In such a system, the invention features a stop associated with each of the bores and providing an alignment surface, typically defined by a cylinder coaxially with the bore and of radius not less than that of a boss. The stop surfaces face generally towards the center of gravity of the tool, each stop surface subtends an arc in the rage of 120° to 180°, and each stop is open on the side of the associated bore opposite the stop surface thereof. In preferred embodiments in which the boom includes a connector defining a second pair of bosses and the brackets define a second pair of coaxial axially-spaced bores, stops are associated also with the bores of the second pair and define stop surfaces, typically cylindrical, facing upwardly in the direction generally opposite to that faced by the first-mentioned stop surfaces, each stop surface defines an arc in the range of 85°–90° on each side of a line parallel to the plane including the axis of the first set of bores and the center of gravity, and guide legs depend from at least one end of the cylindrical surface portion of each stop.

BRIEF DESCRIPTION OF THE DRAWINGS

Other objects, features and advantages of the invention will appear from the following detailed description of a preferred embodiment thereof, taken together with the accompanying drawings in which.

DESCRIPTION OF PREFERRED EMBODIMENT

Figures 1, 2, 3, 4:
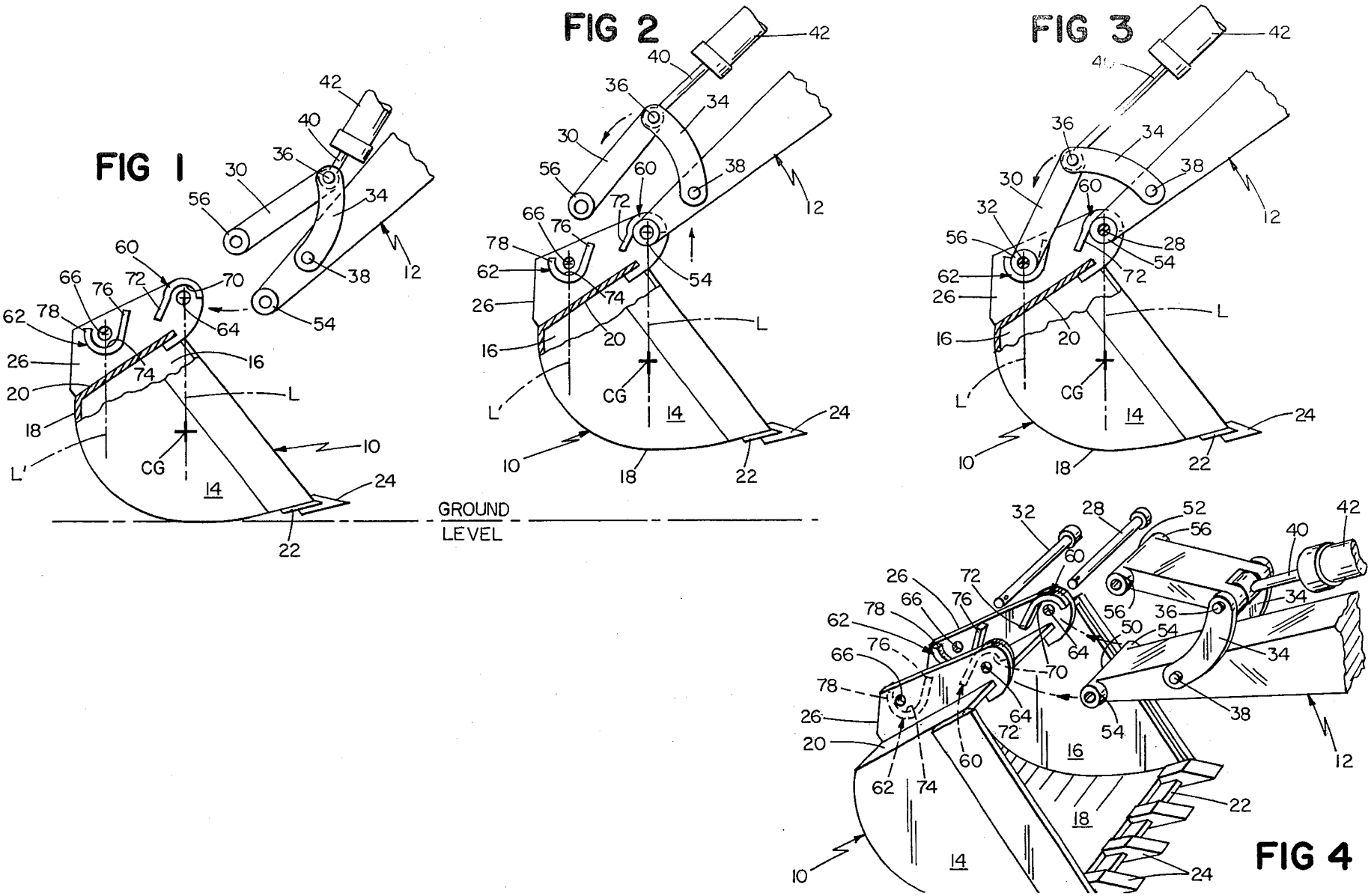
FIGS. 1–3 are partially broken away side elevations of a backhoe dipperstick and linkage and of a materials handling tool which embody the present invention, the figures being slightly simplified and illustrating three stages in the attachment of the tool to the dipperstick.
FIG. 4 is a perspective view of portions of the dipperstick and linkage, and materials handling tool of FIGS. 1–3.

Referring more particularly to FIGS. 1–4, there is shown a bucket 10 pivotally attached to the dipperstick 12 of a hydraulic backhoe.

Bucket 10 is a conventional and has generally triangular spaced side walls 14, 16 joined by a curved, laterally extending rear and bottom wall 18 and an upper mounting plate 20 welded along its edges to the top edges of each of walls 14, 16 and 18. A cutting plate 22 with cutting teeth 24 is welded along the bottom front edge of wall 18. A pair of parallel, spaced brackets 26 are welded along the upper surface of mounting plate 20, and extend parallel to and are spaced inwardly of side walls 14, 16.

The front end of brackets 26 is pivotally connected to dipperstick 12 by a hinge pin 28. A rear portion of brackets 26 is pivotally attached to the adjacent end of the bucket link 30 of the Pilch linkage by hinge pin 32, and the other end of the bucket link 30 is pivotally attached to one end of the other links 34 of the linkage by hinge pin 36. The other ends of links 34 are connected by pin 38 to the opposite sides of dipperstick 12 at a point spaced from pin 28. The piston rod 40 of a hydraulic actuator 42 (for swinging bucket 10 relative to dipperstick 12) is connected to hinge pin 36 connecting bucket link 30 and links 34.

As shown most clearly in FIG. 4, the ends of dipperstick 12 and bucket link 30 to which brackets 26 are connected are narrower than the cross-bucket spacing between the brackets. A dipperstick tube 50 and a bucket link tube 52, each of length slightly less than the cross-bucket spacing between brackets 26 (to form a close fit when placed between and perpendicular to the brackets) are welded to the respective ends of dipperstick 12 and bucket link 30. The axes of tubes 50 and 52 are parallel to each other, to the axes of hinge pins 36 and 38, and to the axis (not shown) of connection of dipperstick 12 to the boom of the backhoe. The portions of tubes 50, 52 projecting beyond the sides of, respectively, dipperstick 12 and bucket link 30 form cylindrical bosses, designated 54, 56 respectively. When bucket 10 is connected to dipperstick 12, pin 28 passes coaxially through dipperstick tube 50, and pin 32 passes through bucket link tube 52.

As described thus far, the construction of bucket 10, dipperstick 12 and the associated linkage 30, 34 is conventional. According to the present invention, two pairs of generally crescent-shaped stops are welded to the inner facing surfaces of brackets 26. One pair of stops, generally designated 60, is welded to the front end of brackets 26, adjacent the point of connection to dipperstick 12; the other pair, generally designated 62 is welded to the center of the brackets, adjacent the point of connection to bucket link 30. As shown, each of stops 60 is adjacent and associated with a bore 64 in a bracket 26 through which dipperstick hinge pin 28 passes; and each of stops 62 is adjacent and associated with a bracket bore 66 for bucket link hinge pin 32. Each stop 60, 62 projects inwardly from a bracket 26 a distance slightly less than the axial length of the one of bosses 54,56 of dipperstick tube 50 and bucket link tube 52 that is associated therewith, and engages a respective boss, as described hereinafter and shown in FIGS. 1–3, when the bucket, dipperstick and linkage are connected.

Each of stops 60 includes a semi-cylindrical portion, defining a semi-cylindrical support surface 70 generally coaxially with the associated bore 64 and of radius equal to that of the outer surface of dipperstick tube bosses 54 and a guide leg 72. Support surface 70 faces downwardly, towards the center of gravity CG of bucket 10. Guide leg 72 points generally down and toward the rear of bucket 10, forming an angle of about 45° with a line L extending from the bucket center of gravity CG to bore 64. In the illustrated embodiment, support surface 70 subtends a total arc of almost 180°, extending almost 90° on each side of an extension of line L. In other embodiments, the total arc subtended by support surface 70 may be in the range of 120° to 180°, and the surface may subtend a larger arc on one side of line L than on the other. Generally, the cylindrical surface 70 will extend at least 45° on each side of line L, and legs such guide leg 72 (extending from one or both ends of surface 70) will be provided so that the entire stop 60 extends through the entire 180° semi-circle facing the bucket center of gravity.

Stops 62 each include a generally semi-cylindrical central portion forming an engagement surface 74 and guide legs 76,78 at opposite ends of the central portion. Each surface 74 has a radius equal to that of the outer surface of bucket link tube bosses 56, extends through an arc of slightly less than 180°, is coaxial with a bore 66 of a respective bracket 26 and faces upwardly, in a direction generally opposite to that faced by surface 70. Guide legs 76, 78 extend upwardly from the opposite ends of surface 74 to points close to the top of bracket 26 and, as shown, diverge slightly from each other. In the illustrated embodiment, surface 74 subtends an arc of about 85° on each side of line L′, parallel to line L and passing through the center of bore 66. In other embodiments, the total arc subtended by cylindrical surface 74 will be in the range of 120° to 180° and the surface will extend not less than about 45° on each side of line L′. Each stop 62 (surface 74 plus legs 76, 80) will extend through an entire 180° semi-circle, and will face upwardly, typically in the direction opposite to the direction from bores 64 to the bucket center of gravity.

In operation, bucket 10 is connected to dipperstick 12 by positioning the dipperstick close to the bucket (FIG. 1) and then rotating dipperstick 12 until dipperstick tube 50 passes between bucket brackets 26 and bosses 54 move into engagement with downwardly facing surfaces 70 of stops 60. Guide legs 72 assist in guiding the bosses 54 of dipperstick tube 50 into such engagement. Rotation of dipperstick 12 is then continued to lift bucket 10 off the ground (FIG. 2). When so lifted, the center of gravity CG of bucket 10 is directly below bores 64, and stops 60 position the bore of dipperstick tube 50 in perfect alignment with bores 64. Hinge pin 28 may then be manually inserted through bores 64 and dipperstick tube 50 in the usual manner.

Bucket link 30 is then extended, by hydraulic actuator 40, to move bucket link tube 52 between brackets 26 and bring bosses 56 into engagement with upwardly facing stop surfaces 76, which align the central bore of tube 52 with bracket bores 66. It will be apparent that the funneling effect of legs 78, 80 assists in guiding bosses 56 of dipperstick tube 56 into position engaging surfaces 76. When the bucket link tube and bracket bores have been thus aligned, hinge pin 32 is manually inserted through them to complete connection of bucket 10 to the dipperstick and linkage.

Other embodiments will be within the scope of the following claims.

What is claimed is:

1. In a system for releasably connecting to a boom a materials handler of the type in which brackets secured to the materials handler define a pair of coaxial axially-spaced bores and in which the boom includes a connector having a pair of coaxial axially-spaced bosses, that improvement wherein:

a stop is mounted on the brackets adjacent each of the bores, each of the stops defines a stop surface projecting from the bracket to which it is mounted in a direction generally parallel to the axis of the bores, facing generally towards the center of gravity of the materials handler, and subtending an arc in the range of 120° to 180° coaxial with the bore and on the side of the bore opposite the center of gravity, each of the stop surfaces is arranged to engage a cylindrical surface of diameter equal to that of a cylindrical surface tangent to the exterior surface of and coaxial with a respective one of the bosses and position the surface so engaged in coaxial alignment with the bore associated therewith, and each of the stops is open on the side of the bore associated therewith opposite the stop surface thereof.

2. The system of claim 1 wherein each of said stop surfaces is defined by a cylinder coaxial with the bore associated therewith and of radius not less than that of the cylinder tangent to the exterior surface of boss associated with the respective bore, and the portion of the cylinder defining each of said stop surfaces extends through an arc in the range of 120° to 180°.

3. In a system for releasably connecting to a boom a materials handler of the type in which brackets secured to the materials handler define first and second pairs of coaxially-spaced bores and in which the boom includes first and second connectors each having a pair of coaxial axially-spaced bosses, the improvement wherein:

a stop is mounted on the brackets adjacent each of the bores;

each of the stops defines a stop surface projecting from the bracket on which it is mounted in a direction generally parallel to the axis of the bore with which it is associated, each said stop surface subtending an arc in the range of 120° to 180° coaxial with the associated bore and being arranged to engage a cylindrical surface of diameter equal to that of a cylindrical surface tangent to the exterior surface of and coaxial with a respective one of the bosses and position the surface so engaged in coaxial alignment with the bore associated therewith;

each of said stops associated with a bore of said first pair is on the side of the bore associated therewith opposite the center of gravity of the materials handler and the stop surface defined thereby faces generally towards said center of gravity;

the stop surface defined by each of the stops associated with a bore of the second pair faces in a direction generally opposite to the direction faced by the stop surfaces defined by said stops associated with bores of said first pair; and, each of the stops is open on the side of the bore associated therewith opposite the stop surface thereof.

4. In a system for releasably connecting to a boom a materials handler of the type in which brackets secured to the materials handler define first and second pairs of coaxially-spaced bores and in which the boom includes first and second connectors each having a pair of coaxial axially-spaced bosses, that improvement wherein:

a stop is mounted on the brackets adjacent each of the bores;

each of the stops defines a stop surface projecting from the bracket on which it is mounted in a direction generally parallel to the axis of the bore with which it is associated, an arc extending through each said stop surface from one side edge thereof to the opposite side edge thereof and coaxial with the bore associated therewith extends through an angle in the range of 120° to 180°, and each said stop surface is arranged to engage a cylindrical surface of diameter equal to that of a cylindrical surface tangent to the exterior surface of and coaxial with a respective one of the bosses and position the surface so engaged in coaxial alignment with the bore associated therewith;

each of said stops associated with a bore of said first pair is on the side of the bore associated therewith opposite the center of gravity of the materials handler and the stop surface defined thereby faces generally towards said center of gravity;

the stop surface defined by each of the stops associated with a bore of the second pair faces in a direction generally opposite to the direction faced by the stop surfaces defined by said stops associated with bores of said first pair; and, each of the stops is open on the side of the bore associated therewith opposite the stop surface thereof.

5. The system of claim 4 wherein the stop surfaces associated with the second pair of bores include portions defined by a cylinder coaxial with the bores of the second pair and having a radius not less then that of a cylinder coaxial with and tangent to a boss of the second connector.

6. The system of claim 5 wherein the stop surfaces associated with the first-mentioned pair of bores include portions defined by a cylinder coaxial with the bores of the first-mentioned pair and having a radius not less than that of a cylinder coaxial with and tangent to a boss of the first-mentioned connector.

7. The system of claim 6 wherein each of said stop surfaces includes a portion defined by a cylinder of radius substantially equal to that of the boss of the connector associated therewith.

8. The system of claim 6 wherein the cylindrical surface portion of each of said stop surfaces subtends an arc of not less than 45° on each side of a respective line extending through the bore associated therewith and parallel to the plane including the axis of the first-mentioned pair of bores and the center of gravity.

9. The system of claim 8 wherein the cylindrical surface portion of each of said stop surfaces subtends an arc in the range of 85° to 90° on each side of the respective line.

10. The system of claim 6 wherein each of said stops includes a guide leg depending from one end of the cylindrical surface portion thereof and defining a guide surface projecting parallel to the axis of the cylindrical portion.

11. The system of claim 10 wherein each of said stops associated with said second pair of bores includes a pair of guide legs depending upwardly from the opposite ends of the cylindrical surface portion thereof and defining a pair of diverging guide surfaces.

12. The system of claim 6 wherein each of said stop surfaces includes a portion defined by a cylinder of the same diameter and subtending an arc in the range of 80° to 90° on each side of a respective line extending through the bore associated therewith and parallel to the plane including the axis of the first-mentioned pair of bores and the center of gravity of the materials handler, the brackets defining the bores are a pair of spaced parallel plates, and the stops are between the plates.

13. The system of claim 4 wherein the axes of said first connector and said second connector are parallel and said connectors are movable relative to each other in a direction generally perpendicular to said axes.

14. The system of claim 4 wherein a connecting pin extends coaxially through each of said bores and the connector associated therewith.

15. The system of claim 14 wherein each of said surfaces and each of said bosses is defined by a cylinder coaxial with the connecting pin extending through the bore and connector associated therewith.

16. In a system for releasably connecting to a boom a materials handler of the type in which brackets secured to the materials handler define a pair of coaxial axially-spaced bores and in which the boom includes a connector having a pair of coaxial axially-spaced bosses, that improvement wherein:

a stop is mounted on the brackets adjacent each of the bores, each of the stops defines a stop surface projecting from the bracket to which it is mounted in a direction generally parallel to the axis of the bores, facing generally towards the center of gravity of the materials handler and on the side of the bore opposite the center of gravity, an arc extending through each of the stop surfaces from one side edge thereof to the opposite side edge thereof and coaxial with the bore associated therewith extends through an angle in the range of 120° to 180°, each of the stop surfaces is arranged to engage a cylindrical surface of diameter equal to that of a cylindrical surface tangent to the exterior surface of and coaxial with a respective one of the bosses and position the surface so engaged in coaxial alignment with the bore associated therewith, and each of the stops is open on the side of the bore associated therewith opposite the stop surface thereof.

* * * * *

UNITED STATES PATENT AND TRADEMARK OFFICE

CERTIFICATE OF CORRECTION

PATENT NO. : 4,127,203
DATED : November 28, 1978
INVENTOR(S) : Carroll H. Arnold It is certified that error appears in the above-identified patent and that said Letters Patent are hereby corrected as shown below:

Filing date of July 29, 1978 should be July 29, 1977

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*